US012428956B2

(12) United States Patent
Trivedi et al.

(10) Patent No.: US 12,428,956 B2
(45) Date of Patent: Sep. 30, 2025

(54) TUNNELING AND NAVIGATION SYSTEMS INCLUDING CONTROLLER CONFIGURED TO DETERMINE ENVIRONMENTAL CHARACTERISTIC

(71) Applicant: General Electric Company, Schenectady, NY (US)

(72) Inventors: Deepak Trivedi, Halfmoon, NY (US); Yew Teck Tan, Schenectady, NY (US); Emad A. Andarawis, Ballston Lake, NY (US)

(73) Assignee: GE Infrastructure Technology LLC, Greenville, SC (US)

( * ) Notice: Subject to any disclaimer, the term of this patent is extended or adjusted under 35 U.S.C. 154(b) by 17 days.

(21) Appl. No.: 17/981,945

(22) Filed: Nov. 7, 2022

(65) Prior Publication Data

US 2024/0159145 A1 May 16, 2024

(51) Int. Cl.
*E21B 49/00* (2006.01)
*E21B 7/26* (2006.01)

(52) U.S. Cl.
CPC ..... *E21B 49/003* (2013.01); *E21B 7/267* (2020.05)

(58) Field of Classification Search
CPC ..... E21B 29/003; E21B 29/00; E21B 7/267; E21B 7/26; E21B 23/001
See application file for complete search history.

(56) References Cited

U.S. PATENT DOCUMENTS 3,525,111 A 8/1970 Von Arx
4,095,655 A * 6/1978 Still ..... E21B 7/26 175/73
4,475,260 A 10/1984 Beck
(Continued)

FOREIGN PATENT DOCUMENTS

AT 409161 B 6/2002
CN 102493763 A 6/2012
(Continued)

OTHER PUBLICATIONS

Azevedo et al., "Numerical Analysis of a Tunnel in Residual Soils", Journal of Geotechnical and Geoenvironmental Engineering, Mar. 1, 2002, pp. 227-236, 128(3).
(Continued)

*Primary Examiner* — George S Gray
(74) *Attorney, Agent, or Firm* — Armstrong Teasdale LLP

(57) ABSTRACT

A system for use in navigating and/or forming a tunnel includes a tunneling device including a body assembly and a fluid line coupled to the body assembly. The body assembly includes a first section and a second section that are configured to selectively adjust their size and move the body assembly through an underground location when a pressurized fluid is delivered to the body assembly through the fluid line. The system further includes at least one sensor coupled to the body assembly and/or the fluid line. The at least one sensor is configured to provide information related to an operating parameter of at least one of the first section of the body assembly or the second section of the body assembly.
(Continued)

The system also includes a controller configured to determine an environmental characteristic of the tunnel based on the information provided by the at least one sensor.

20 Claims, 5 Drawing Sheets

(56) References Cited

U.S. PATENT DOCUMENTS

| | | | | |
|---|---|---|---|---|
| 5,423,630 | A | 6/1995 | Imoto et al. | |
| 5,758,731 | A | 6/1998 | Zollinger | |
| 6,107,795 | A | 8/2000 | Smart | |
| 6,371,631 | B1 | 4/2002 | Reutemann | |
| 6,514,346 | B1 | 2/2003 | Nichols | |
| 6,959,772 | B2 | 11/2005 | Stegmaier et al. | |
| 7,055,625 | B1 | 6/2006 | Myrick et al. | |
| 7,210,364 | B2 | 5/2007 | Ghorbel et al. | |
| 7,812,328 | B2 | 10/2010 | Betz | |
| 9,500,077 | B2 | 11/2016 | Li et al. | |
| 11,255,479 | B2 | 2/2022 | Radichel et al. | |
| 2003/0039752 | A1 | 2/2003 | Winiewicz et al. | |
| 2004/0173363 | A1* | 9/2004 | Navarro-Sorroche | E21B 47/06 166/387 |
| 2004/0226747 | A1* | 11/2004 | Stegmaier | E21B 7/067 175/73 |
| 2012/0313790 | A1* | 12/2012 | Heijnen | E21B 47/13 340/854.6 |
| 2019/0064387 | A1* | 2/2019 | Ohanian, III | G01N 21/47 |
| 2021/0025533 | A1 | 1/2021 | Duncan et al. | |
| 2021/0025534 | A1 | 1/2021 | Duncan et al. | |
| 2021/0025535 | A1 | 1/2021 | Duncan et al. | |
| 2021/0025536 | A1 | 1/2021 | Duncan et al. | |

FOREIGN PATENT DOCUMENTS

| | | | |
|---|---|---|---|
| CN | 205743913 | U | 11/2016 |
| CN | 113740920 | A | 12/2021 |
| CN | 112012756 | B | 3/2022 |
| CN | 114179053 | A | 3/2022 |
| EP | 0433963 | B1 | 6/1994 |
| WO | 2009071520 | A2 | 11/2009 |
| WO | 2017197418 | A1 | 11/2017 |

OTHER PUBLICATIONS

Jong et al., "State-Of-The-Art Review of Geotechnical-Driven Artificial Intelligence Techniques In Underground Soil-Structure Interaction", Tunnelling and Underground Space Technology, 2021, 113.

* cited by examiner

TUNNELING AND NAVIGATION SYSTEMS INCLUDING CONTROLLER CONFIGURED TO DETERMINE ENVIRONMENTAL CHARACTERISTIC

STATEMENT REGARDING FEDERALLY SPONSORED RESEARCH AND DEVELOPMENT

This invention was made with Government support under contract number D19AC00018 awarded by the Defense Advanced Research Projects Agency (DARPA). The Government has certain rights in this invention.

BACKGROUND

The field of the disclosure relates to tunneling and navigation systems, and more particularly to tunneling and navigation systems including a controller configured to determine environmental characteristics.

Tunneling devices are used to travel through underground locations and displace material to form and shape tunnels through the underground locations. At least some tunneling devices include a drive system to propel the tunneling devices through underground locations. A tool may be positioned at the front of the tunneling devices to displace material and form an interior cavity of the tunnel as the tunneling devices travel through the underground locations. In addition, a separate apparatus is typically required to remove the displaced material from the tunnel.

The underground locations may have varying conditions and obstacles that make travel and access difficult. In addition, environmental characteristics of the underground locations may affect operation of the tunneling devices. For example, the tool on the front of the tunneling device may not operate efficiently to displace some materials and/or environmental characteristics within the underground location may affect operation of the tool. However, the tunneling devices may have limited ability to detect conditions, obstacles, and environmental characteristics within and around the underground location. As a result, the tunneling device may encounter conditions, obstacles, and environmental characteristics that hinder or slow travel and/or otherwise affect operation of the tunneling device.

Accordingly, it is desirable to provide a tunneling device that is configured to travel through difficult to access locations. In addition, it is desirable to provide a system that is configured to determine environmental characteristics based on operating parameters of the tunneling device as the tunneling device moves through the difficult to access locations.

BRIEF DESCRIPTION

In one aspect, a system for use in navigating and/or forming a tunnel having a sidewall defining an interior cavity is provided. The system includes a tunneling device including a body assembly and a fluid line coupled to the body assembly. The body assembly includes a first section and a second section coupled to the first section that are configured to selectively adjust their size and move the body assembly through an underground location when a pressurized fluid is delivered to the body assembly through the fluid line. The system further includes at least one sensor coupled to the body assembly and/or the fluid line. The at least one sensor is configured to provide information related to an operating parameter of at least one of the first section of the body assembly and the second section of the body assembly. The system also includes a controller communicatively coupled to the at least one sensor and configured to determine an environmental characteristic of the tunnel based on the information provided by the at least one sensor.

In another aspect, a tunneling device includes a body assembly including a first section and a second section coupled to the first section. The first section is configured to switch from a first configuration having a first width to a second configuration having a second width when a pressurized fluid is delivered to the first section. The second section is configured to switch from a third configuration having a third width to a fourth configuration having a fourth width when the pressurized fluid is delivered to the second section. The first section and the second section of the body assembly are configured to selectively switch between the first configuration and the second configuration and between the third configuration and the fourth configuration and move the body assembly through an underground location. The body assembly is communicatively coupled to a controller configured to provide instructions to move the body assembly through the underground location and to determine an environmental characteristic based on information provided by at least one sensor. The tunneling device also includes a tip coupled to the body assembly and configured to displace material and form a tunnel having a sidewall defining an interior cavity when the body assembly moves through the underground location. The fourth width of the second section of the body assembly is larger than the second width of the first section of the body assembly such that the second section of the body assembly is configured to engage the sidewall of the tunnel and enlarge the interior cavity of the tunnel when the body assembly moves through the underground location.

In yet another aspect, a method for navigating and/or forming a tunnel having a sidewall defining an interior cavity is provided. The method includes positioning a tunneling device within the interior cavity. The tunneling device includes a body assembly including a first section and a second section. The method also includes delivering, via a fluid line, pressurized fluid to the body assembly. The first section and the second section of the body assembly are configured to selectively adjust their size and move the body assembly through the interior cavity when the pressurized fluid is delivered to the body assembly. The method further includes determining, by a controller, an environmental characteristic of the tunnel based on information provided by at least one sensor coupled to the body assembly and/or to the fluid line. The information is related to an operating parameter of at least one of the first section of the body assembly and the second section of the body assembly.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
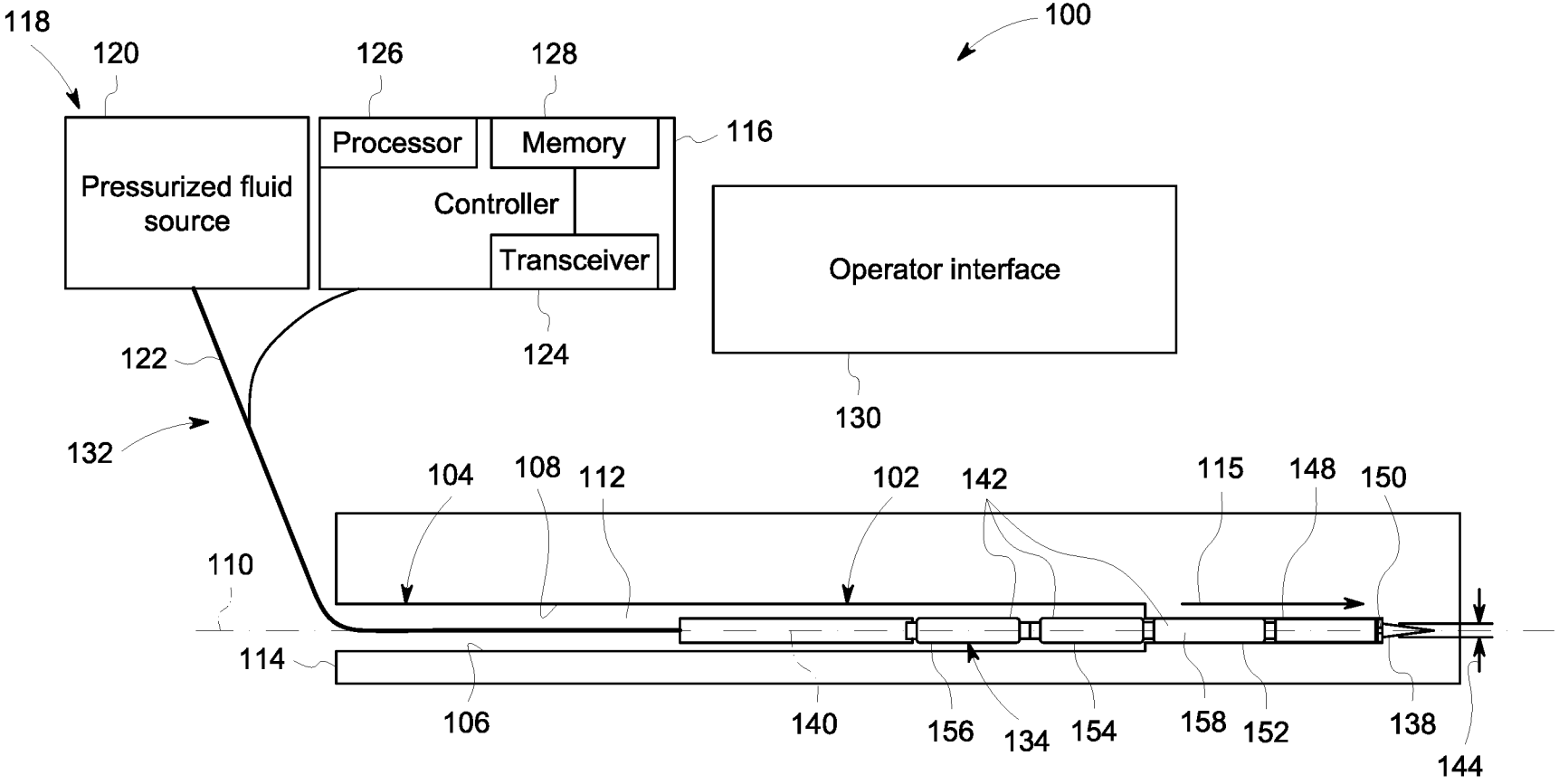
FIG. 1 is a schematic diagram of a system including one embodiment of a tunneling device traveling underground.

Unless otherwise indicated, the drawings provided herein are meant to illustrate features of embodiments of this disclosure. These features are believed to be applicable in a wide variety of systems including one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer," and related terms, e.g., "processing device," "computing device," and "controller" are not limited to just those integrated circuits referred to in the art as a computer, but broadly refers to a microcontroller, a microcomputer, an analog computer, a programmable logic controller (PLC), and application specific integrated circuit (ASIC), and other programmable circuits, and these terms are used interchangeably herein. In the embodiments described herein, "memory" may include, but is not limited to, a computer-readable medium, such as a random access memory (RAM), a computer-readable non-volatile medium, such as a flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a touchscreen, a mouse, and a keyboard. Alternatively, other computer peripherals may also be used that may include, for example, but not be limited to, a scanner. Furthermore, in the example embodiment, additional output channels may include, but not be limited to, an operator interface monitor or heads-up display. Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an ASIC, a PLC, a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

Embodiments described herein relate to a system including a tunneling device. The tunneling device includes a body assembly including a plurality of sections and a tip coupled to the body assembly. The plurality of sections of the body assembly are configured to selectively adjust their size and move the body assembly through an underground location when a pressurized fluid is delivered to the body assembly through a fluid line. For example, a first section of the body assembly is expandable in a direction perpendicular to the longitudinal axis between a first configuration having a first width measured perpendicular to the longitudinal axis, and a second configuration having a second width measured perpendicular to the longitudinal axis when pressurized fluid is delivered to the first section of the body assembly. A second section of the body assembly is expandable in a direction perpendicular to the longitudinal axis between a third configuration having a third width measured perpendicular to the longitudinal axis, and a fourth configuration having a fourth width measured perpendicular to the longitudinal axis when pressurized fluid is delivered to the second section of the body assembly. The tip is coupled to the body assembly and configured to lead the body assembly through the underground location when the body assembly is moving forward. For example, the tip may include a tunnelling tool configured to displace material and form a tunnel as the body assembly moves through the underground location. In some embodiments, the second width of the first section of the body assembly is larger than a width of the tip, and the fourth width of the second section of the body assembly is larger than the second width of the first section of the body assembly such that the body assembly is configured to enlarge the interior cavity of the tunnel when the body assembly moves through the underground location. In addition, in some embodiments, the system also includes at least one sensor coupled to the body assembly and/or the fluid line, and a controller communicatively coupled to the at least one sensor. The at least one sensor is configured to provide information related to an operating parameter of at least one of the first section of the body assembly and the second section of the body assembly. The controller is configured to determine an environmental characteristic of the tunnel based on the information provided by the at least one sensor. The environmental characteristic may be used to adjust operation of the tunneling device to avoid obstacles or conditions and/or improve operating efficiency of the tunneling device. In addition, the characteristic may be used to determine environmental characteristics, e.g., soil characterization, solely for the purpose of surveying and without adjusting operation of the tunnel device based on the environmental characteristic.

FIG. 1 is a schematic diagram of a system 100 including a tunneling device 102 traveling underground. For example, tunneling device 102 is configured to travel through a tunnel 104 and/or displace material to form tunnel 104. Tunnel 104 includes a sidewall 106 having an interior surface 108 extending around a central axis 110 and defining an interior cavity 112. Tunneling device 102 is configured to fit within interior cavity 112 and travel along the length of tunnel 104. Accordingly, tunneling device 102 facilitates construction of tunnel 104 and/or inspection and repair of tunnel 104. Moreover, tunneling device 102 is self-propelled, meaning that tunneling device 102 moves within interior cavity 112 without an external force acting on tunneling device 102.

During operation, for example, tunneling device 102 may be positioned at a surface 114 proximate an underground location and tunneling device 102 travels through surface 114 to form an opening into tunnel 104. In the illustrated embodiment, tunneling device 102 travels in a travel direction 115. In some embodiments, tunneling device 102 traverses transitions in tunnel 104 such as bends or size transitions. As tunneling device 102 travels through underground locations, tunneling device 102 is configured to form tunnel 104 and/or inspect and/or repair any portions of tunnel 104.

System 100 includes tunneling device 102, a controller 116 communicatively coupled to tunneling device 102, and a fluid supply system 118. Fluid supply system 118 includes a pressurized fluid source 120 that is coupled to tunneling device 102 via a fluid line 122. Fluid supply system 118 is configured to regulate pressurized fluid that is delivered to/removed from tunneling device 102 for operation of tunneling device 102, as described further herein.

In addition, in the example embodiment, controller 116 is configured to provide instructions to move tunneling device 102 through tunnel 104 and/or to perform inspection or repair operations. Controller 116 includes a transceiver 124, a processor 126, and a memory 128. In some embodiments, controller 116 is positioned remotely from tunneling device 102, e.g., controller 116 is located at a base station that enables an operator on an exterior of tunnel 104 (shown in FIG. 1) to interact with tunneling device 102, and/or controller 116 can be at least partly incorporated into and located on board tunneling device 102. Transceiver 124 is communicatively coupled with tunneling device 102 and is configured to send information to and receive information from a transceiver of tunneling device 102. In some embodiments, transceiver 124 and a transceiver on tunneling device 102 communicate wirelessly. In alternative embodiments, tunneling device 102 and controller 116 communicate in any manner that enables system 100 to operate as described herein. For example, in some embodiments, controller 116 and tunneling device 102 exchange information through a wired link extending between tunneling device 102 and controller 116.

In addition, in some embodiments, controller 116 is at least partly located on board tunneling device 102 and is configured to execute instructions for controlling components of tunneling device 102, such as a maintenance device and drive systems. For example, controller 116 executes instructions that cause tunneling device 102 to move in a selected direction. In alternative embodiments, tunneling device 102 includes any controller that enables system 100 to operate as described herein. In some embodiments, controller 116 is not located on board tunneling device 102.

In some embodiments, tunneling device 102 includes one or more sensors and/or repair tools or pipe maintenance tools. For example, in some embodiments, tunneling device 102 includes a repair tool configured to repair interior surface 108, or an inspection tool configured to inspect a portion of interior cavity 112.

Also, in the example embodiment, an operator interface 130 is configured to display information relating to the characteristics detected by tunneling device 102 for interpretation by the operator. Operator interface 130 may be included on a remote computing device (not shown) and/or may be incorporated with controller 116. Operator interface 130 may include, among other possibilities, a web browser and/or a client application. For example, in some embodiments, operator interface 130 displays images of interior surface 108 based on received signals. In some embodiments, operator interface 130 allows an operator to input and/or view information relating to control of tunneling device 102. In the example embodiment, operator interface 130 is configured to display information relating to the state of one or more of a maintenance device and a power source for interpretation by the operator. State information may also include, for example and without limitation, a charge status of a power source, a current draw for various drive and positioning motors, a pressure in one or more muscles, a diameter and/or length of one or more muscles, a state of one or more valves, and/or a flow rate in a channel of the fluidic circuit. In various embodiments, processor 126 translates operator inputs into steering, tool motion, camera control, sensor control, sensor motion, and/or any other commands and sends information via transceiver 124 to tunneling device 102 via a transceiver of tunneling device 102. In some embodiments, operator control of tunneling device 102 is in real time, such as through a joystick, a keyboard, a touchscreen, a remote motion capture system, and/or a wearable motion capture system or other interface having similar function. In other embodiments, tunneling device 102 is controlled partially or wholly according to a preprogrammed routine. In further embodiments, tunneling device 102 is at least partially automated. In some embodiments, an operator inputs information such as operation goals or conditional directions. In further embodiments, information, such as information received by controller 116 from tunneling device 102, control data sent to tunneling device 102, and additional operator inputs or state information (e.g., location, time, orientation, datalink quality, battery levels, repair material levels, failure mode indicators), is logged into memory 128.

Moreover, in the example embodiment, controller 116 is positioned on the exterior of tunnel 104 and communicates with tunneling device 102 positioned within interior cavity 112 of tunnel 104. For example, controller 116 is configured to send information to tunneling device 102 relating to the propulsion and/or steering of tunneling device 102 while tunneling device 102 is moving within interior cavity 112 of tunnel 104 through a wireless connection and/or a tether 132. In alternative embodiments, controller 116 and tunneling device 102 are configured in any manner that enables system 100 to operate as described herein.

Tunneling device 102 includes a body assembly 134 and a tip 138 coupled to body assembly 134. Body assembly 134 of tunneling device 102 has a longitudinal axis 140. Body assembly 134 includes a plurality of sections 142 that extend along longitudinal axis 140. Sections 142 of body assembly 134 are modular and are detachably coupled together. Sections 142 of body assembly 134 are configured to move body assembly 134 through underground locations. For example, sections 142 of body assembly 134 selectively expand and contract (e.g., widths and/or lengths of sections 142 selectively increase and/or decrease) to propel body assembly 134 through tunnel 104. For example, each section 142 of body assembly 134 is configured to switch from a first configuration having a first length and a first width to a second configuration having a second length and/or a second width. The length and width of each section 142 of body assembly 134 may be switched independently and/or in unison when section 142 switches configuration. For example, in some embodiments, only the width of each section 142 of body assembly 134 changes when section 142 switches configurations. In other embodiments, only the length of each section 142 of body assembly 134 changes when section 142 switches configurations. In further embodiments, both the width and length of each section 142 of body assembly may be changed when section 142 switches configurations.

In the example embodiment, each section 142 of body assembly 134 includes an artificial muscle consisting of a bladder 158 including an elastomeric tubular material that is configured to expand/collapse when pressurized fluid is delivered/removed from bladder 158. In addition, each section 142 of body assembly 134 includes reinforcement (e.g., fibers) that extend around bladder 158 and are connected to radial and axial actuators. In the example embodiment, the reinforcement form a fiber mesh pattern that constrains the direction and amount of expansion of bladder 158 based on a fiber reinforcement angle determined by the initial construction and the level of actuation of the artificial muscle. For example, the fibers may form a first pattern (e.g., a tight mesh grid around the circumference of bladder) that allows bladder 158 to expand in an axial direction but not in a radial direction when bladder 158 is pressurized. Conversely, the muscles may form a second pattern (e.g., a looser mesh grid around the circumference of bladder 158 allowing radial expansion or stretching of the mesh) that allows bladder 158 to expand in the radial direction but not the axial direction when bladder 158 is pressurized. In addition, the fiber reinforcement angle is designed to arrest the deformation of bladder 158 at a pre-defined setpoint in the radial and/or axial direction when bladder 158 is pressurized. In the example embodiment, the fiber reinforcement angle of the muscles is between 10 degrees and 50 degrees with respect to the circumferential axis of the bladder The pneumatic artificial muscles operate based on instructions from controller 116 to cooperatively propel body assembly 134 in desired directions. In alternative embodiments, tunneling device 102 includes any section 142 that enables tunneling device 102 to operate as described herein.

Sections 142 of body assembly 134 are designed to provide an axial force and a radial force that propel body assembly 134 and tether 132 through underground locations. In the example embodiment, body assembly 134 and tether 132 do not require a separate linear actuator for propulsion. In some embodiments, body assembly 134 includes at least three sections 142 (e.g., a first section 152, a second section 154, and a third section 156) that are configured to cooperate and provide a crawling action to propel body assembly 134 through tunnel 104. In alternative embodiments, tunneling device 102 includes any body assembly 134 that enables tunneling device 102 to operate as described herein.

Also, in the example embodiment, body assembly 134 includes a force transmitter 148 coupled to tip 138 and configured to move tip 138 in a direction parallel to longitudinal axis 140. For example, a shaft 150 is coupled to and extends between force transmitter 148 and tip 138. Force transmitter 148 is configured to cause shaft 150 and tip 138 to move in the direction parallel to longitudinal axis 140 and/or in a rotational direction about longitudinal axis 140. Tip 138 is shaped to engage material and displace material when force transmitter 148 causes shaft 150 and tip 138 to move. For example, tip 138 includes a tunnelling tool configured to displace material as tip 138 moves. In the example embodiment, tip 138 is a cone having a width 144 and tapering to a point that is configured to engage the material. In alternative embodiments, tip 138 is any shape that enables tunneling device 102 to operate as described herein. For example, in some embodiments, tip 138 includes a blade, a helix, a sphere, and/or any other suitable shape.

In some embodiments, tip 138 includes at least one of a sensor and/or a repair tool, and tip 138 is configured to perform a maintenance operation within tunnel 104. For example, in some embodiments, tip 138 includes, without limitation, any of the following: an applicator, a drill, a grinder, a heater, a welding electrode, a sprayer, an optical sensor (e.g., visible, infrared, and/or multi-spectral sensor), a mechanical sensor (e.g., stylus profilometer, coordinate measurement probe, load transducer, linear variable differential transformer), a thermal sensor (e.g., pyrometer, thermocouple, resistance temperature detector), a magnetic sensor, an acoustic sensor (e.g., piezoelectric, microphone, ultrasound), and an electromagnetic sensor (e.g., eddy current, potential drop, x-ray). In some embodiments, a maintenance device on tip 138 is used to provide information for steering tunneling device 102 and/or to perform a maintenance operation. In alternative embodiments, tunneling device 102 includes any tip 138 that enables tunneling device 102 to operate as described herein.

In addition, in some embodiments, tunneling device 102 includes a light source (not shown) configured to irradiate at least a portion of interior cavity 112 to facilitate visual or non-visual steering of tunneling device 102 and/or to allow a maintenance device to capture images, for example. The light source may be coupled to body assembly 134 and, in some embodiments, may be positionable relative to body assembly 134. In alternative embodiments, tunneling device 102 includes any light source that enables tunneling device 102 to operate as described herein.

Figure 2:
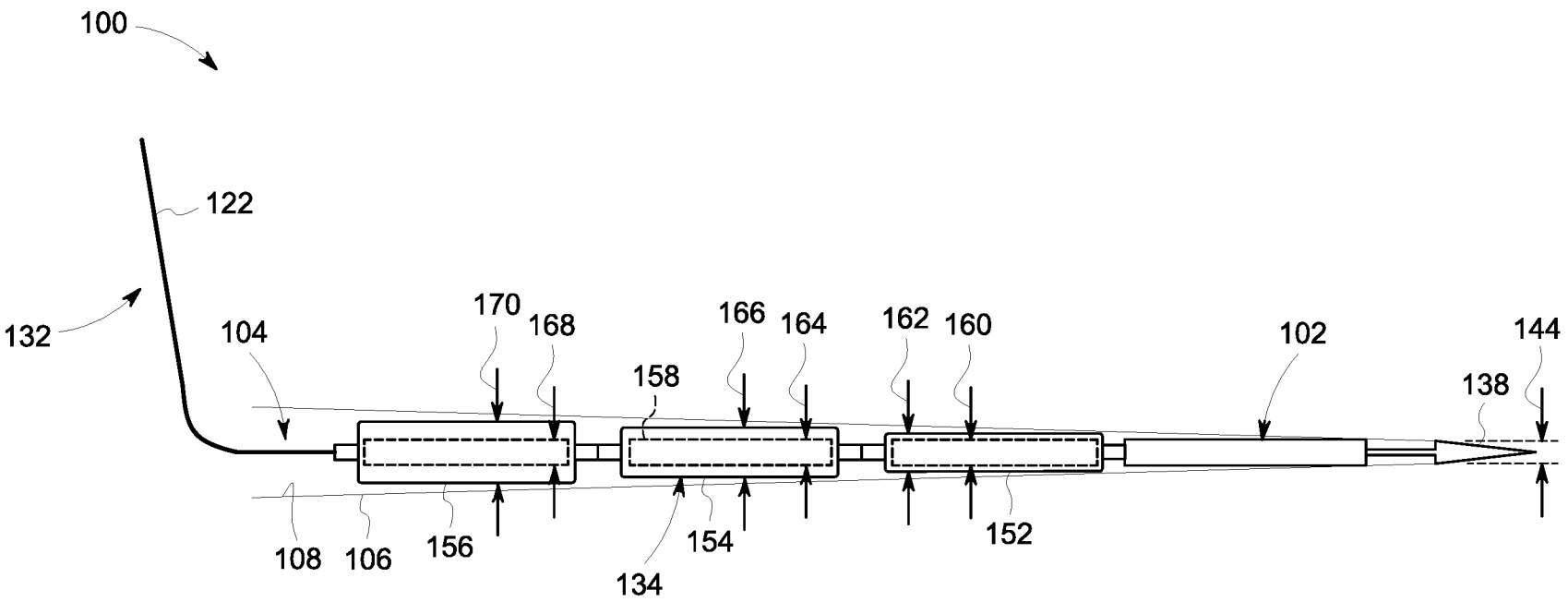
FIG. 2 is a side view of a portion of the tunneling device shown in FIG. 1, the tunneling device including a plurality of sections that are configured to selectively adjust their size and move the tunneling device through an underground location.

FIG. 2 is a side view of a portion of tunneling device 102. In the example embodiment, sections 142 of body assembly 134 are configured to selectively adjust their size and move body assembly 134 through an underground location. For example, first section 152 of body assembly 134 has a first width 160 measured perpendicular to longitudinal axis 140 in a first configuration and a second width 162 measured perpendicular to longitudinal axis 140 in a second configuration. Second section 154 of body assembly 134 has a third width 164 measured perpendicular to longitudinal axis 140 in a third configuration and a fourth width 166 measured perpendicular to longitudinal axis 140 in a fourth configuration. Third section 156 of body assembly 134 has a fifth width 168 measured perpendicular to longitudinal axis 140 in a fifth configuration and a sixth width 170 measured perpendicular to longitudinal axis 140 in a sixth configuration. Tip 138 has a width 144 measured perpendicular to longitudinal axis 140. First width 160 of first section 152 is equal to or less than width 144 of tip 138. In contrast, second width 162 of first section 152, and fourth width 166 of second section 154 are larger than width 144 of tip 138. In addition, fourth width 166 of second section 154 is larger than second width 162 of first section 152.

Accordingly, in the first configuration and third configuration, first section 152 and second section 154 are within the radial extents of tip 138 and body assembly 134 fits in a first section tunnel 104 (shown in FIG. 1) formed by tip 138 without engaging sidewalls 106 (shown in FIG. 1) of tunnel 104. In the second configuration, first section 152 of body assembly 134 extends beyond the radial extents of tip 138 and is configured to engage sidewalls 106 the first section of tunnel 104. In addition, in the fourth configuration, second section 154 of body assembly 134 extends beyond the radial extents of first section 152 and is configured to engage sidewalls 106 of the first section of tunnel 104 and enlarge interior cavity 112 of tunnel 104. As a result, sections 142 selectively engage sidewalls 106 of tunnel 104 to facilitate movement of body assembly 134 and/or movement of tip 138. In addition, body assembly 134 compacts material in sidewalls 106 to expand tunnel 104 in progressive sections. For example, the pressure provided by sections 142 exceeds a cavity expansion pressure of the material surrounding tunneling device 102 and, thus, body assembly 134 displaces the material and enlarges tunnel 104 (shown in FIG. 1) in progressive sections. Body assembly 134 progressively expands interior cavity 112 of tunnel 104 as body assembly 134 travels through tunnel 104 because sections 142 of body assembly 134 have progressively larger widths from tip 138 to an opposite end of body assembly 134.

Figure 3:
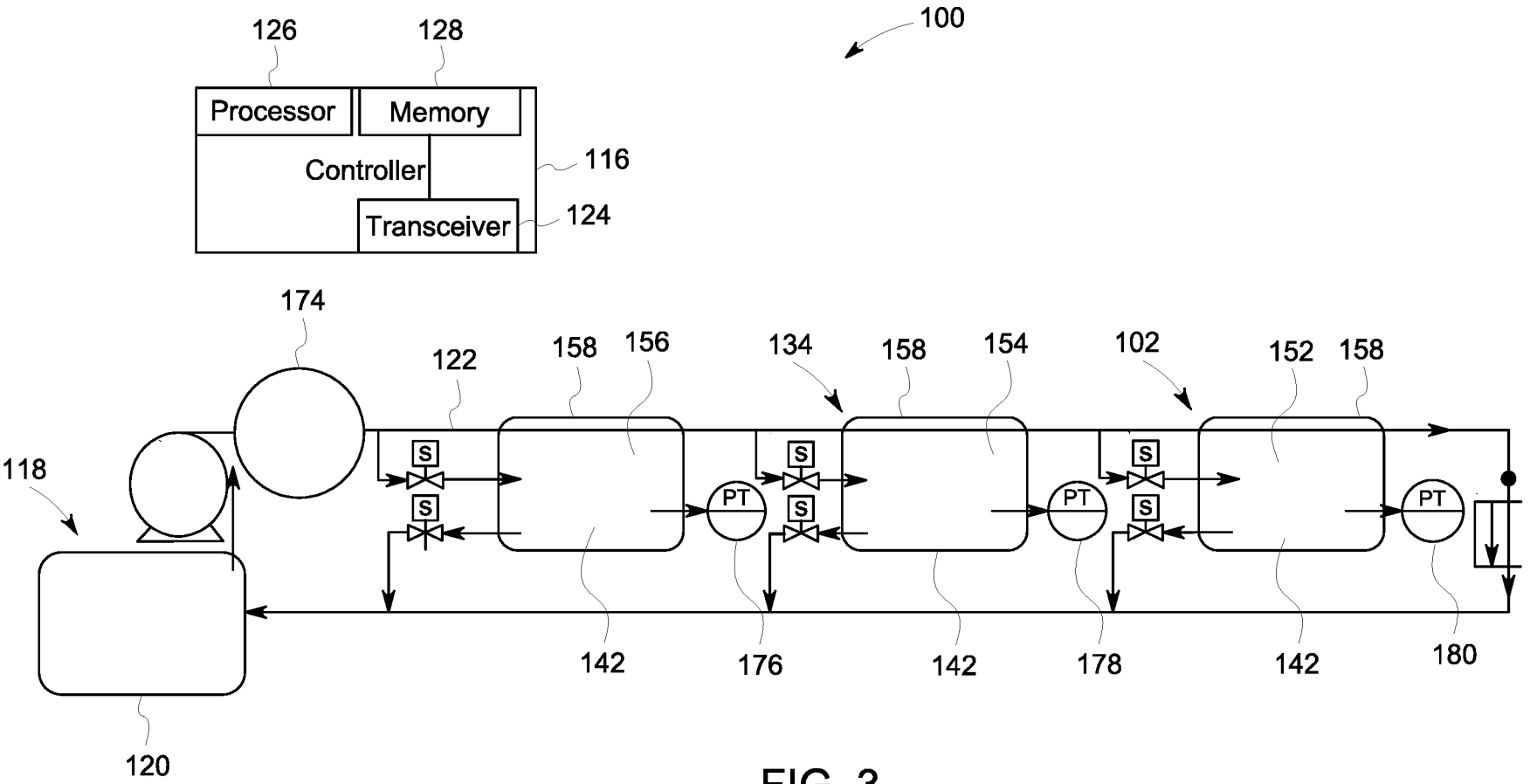
FIG. 3 is a schematic diagram of the system shown in FIG. 1, illustrating flow of pressurized fluid through a pressurized fluid source and the body assembly of the tunneling device.

FIG. 3 is a schematic diagram of system 100 illustrating flow of pressurized fluid between pressurized fluid source 120 and body assembly 134 of tunneling device 102. In the example embodiment, pressurized fluid source 120 is coupled to one or more components of tunneling device 102 via fluid line 122. For example, pressurized fluid source 120 is coupled to bladder 158 of at least one section 142 of body assembly 134 via fluid line 122. In the example embodiment, fluid line 122 is coupled to bladders 158 of first section 152, second section 154, and third section 156. Each bladder 158 is configured to transition respective section 152, 154, 156 of body assembly 134 from the first configuration to the second configuration when pressurized fluid is delivered to bladder 158 via fluid line 122, and to transition respective section 142 of body assembly 134 from the second configuration to the first configuration when the pressurized fluid is removed from bladder 158 via fluid line 122. As a result, sections 142 of body assembly 134 are configured to selectively adjust their size and move body assembly 134 through an underground location when a pressurized fluid is delivered to or removed from sections 142 of body assembly through fluid line 122. In the example embodiment, sections 142 of body assembly 134 are configured to selectively switch configurations and propel body assembly 134 when pressurized fluid is delivered to or removed from sections 142 via fluid line 122. In alternative embodiments, system 100 includes any pressurized fluid source 120 that enables system 100 to operate as described herein. For example, in some embodiments, pressurized fluid source 120 includes separate fluid tanks and/or pumps that are coupled to and configured to regulate pressurized fluid in bladders 158 of sections 142. In addition, in some embodiments, system 100 includes a plurality of fluid lines 122 coupled to body assembly 134. In some embodiments, pressurized fluid exhausted from bladders 158 is directed through a return fluid line 122 that may be included in tether 132 (shown in FIG. 1). In further embodiments, system 100 does not include a return fluid line and the exhaust fluid is released within interior cavity 112 (shown in FIG. 1).

System 100 includes at least one sensor coupled to body assembly 134 or fluid line 122 and configured to provide information related to an operating parameter of at least one of sections 142 of body assembly 134. In the example embodiment, system 100 includes a first sensor 174 coupled to fluid line 122, a second sensor 176 coupled to first section 152 of body assembly 134, a third sensor 178 coupled to second section 154 of body assembly 134, and a fourth sensor 180 coupled to third section 156 of body assembly 134. First sensor 174 includes a flow meter that is configured to measure a flow rate of the pressurized fluid provided to or removed from at least one section 142 of body assembly 134. In the example embodiment, second sensor 176, third sensor 178, and fourth sensor 180 each include a pressure transducer configured to measure a pressure of the respective section. In alternative embodiments, system 100 includes any sensor that enables system 100 to operate as described herein.

Controller 116 is communicatively coupled to first sensor 174, second sensor 176, third sensor 178, and fourth sensor 180. In the example embodiment, controller 116 is configured to determine an operating parameter of first section 152 of body assembly 134, an operating parameter of second section 154 of body assembly 134, and an operating parameter of third section 156 of body assembly 134 based on the information provided by, respectively, first sensor 174, second sensor 176, third sensor 178, and/or fourth sensor 180. The operating parameter of sections 142 of body assembly 134 may be, for example, a pressure of fluid within section 142, a contact force or pressure between section 142 and sidewall 106, a displacement, a temperature, or any other operating parameter. In the example embodiment, controller 116 determines a pressure of sections 142 of body assembly and a flow characteristic of pressurized fluid within fluid line 122. For example, in some embodiments, controller 116 determines a flow characteristic of the pressurized fluid delivered to or removed from sections 142 of body assembly 134 through fluid line 122, a pressure of first section 152 of body assembly 134 in the second configuration, a pressure of second section 154 of body assembly 134 in the fourth configuration, a pressure of third section 156 of body assembly 134 in the sixth configuration, a change in width and/or length of first section 152 of body assembly 134 when the pressurized fluid is delivered to or removed from first section 152 of body assembly 134 through fluid line, a change in width of second section 154 of body assembly 134 when the pressurized fluid is delivered to or removed from second section 154 of body assembly 134 through fluid line 122, and/or a change in width of third section 156 of body assembly 134 when the pressurized fluid is delivered to or removed from third section 156 of body assembly 134 through fluid line 122. In some embodiments, controller 116 compares the operating parameters of different sections 142 of body assembly 134. Controller 116 diagnoses issues or identifies errors or irregularities of the operating parameters of one or more of sections 142 of body assembly 134 based on differences in the operating parameters of sections 142 and/or controller 116 compares the operating parameters with a set of expected values or a library of known failure mode signatures. In addition, controller 116 determines if any differences in the measurements are caused by material properties and/or deterioration of sections 142 of body assembly 134 based on the comparison.

Also, in the example embodiment, controller 116 is configured to determine an environmental characteristic of tunnel 104 based on the information provided by one or more of first sensor 174, second sensor 176, third sensor 178, and/or fourth sensor 180. For example, controller 116 determines an environmental characteristic of tunnel 104 based on the determined pressure of one or more sections 142 of body assembly 134. The environmental characteristic may include a compressive strength of the material surrounding tunneling device 102, a shear strength of the material surrounding tunneling device 102, a Young's modulus of the material surrounding tunneling device 102, or a cavity expansion pressure. For example, controller 116 determines a pressure and a displacement of at least one of sections 142 of body assembly 134 based on information provided by first sensor 174, second sensor 176, third sensor 178, and/or fourth sensor 180 and determines a compressive strength of the material around tunneling device 102 based on the determined pressure and displacement. In some embodiments, controller 116 includes a classification system to classify one or more properties or conditions of soil in the underground location based on the determined operating parameter. The properties or conditions of the soil may include soil type, moisture content, compressive strength, soil pressure, and/or any other properties or conditions. In alternative embodiments, controller 116 determines any environmental characteristic that enables system 100 to operate as described herein.

In some embodiments, controller 116 creates an environmental characteristic map of the underground location based on the environmental characteristics. For example, the environmental characteristics may be tied to specific locations to create a map which can be used in conjunction with an environmental survey. Controller 116 may determine and store the environmental characteristics without relying on the environmental characteristics during operation.

In the example embodiment, the environmental characteristic determined by controller 116 is used to adjust operation of tunneling device 102. For example, controller 116 is configured to send instructions to tunneling device 102 to move body assembly 134 through tunnel 104. Controller 116 determines the instructions based in part on the environmental characteristic of tunnel 104 and can adjust operation of tunneling device 102 based on the environmental characteristic. For example, controller 116 can adjust the expansion or contraction of sections 142 based on the environmental characteristic by regulating the pressurized fluid provided through fluid line 122. Also, operation or the configuration of tip 138 may be adjusted based on the environmental characteristic. For example, the environmental characteristic may be stored during an initial survey of the underground location and for a subsequent trip through the underground location, tip 138 may include a tool that is selected based on the previously stored environmental characteristic. In further embodiments, the size and/or shape of tip 138 and/or a movement speed and/or force of tip 138 may be dynamically adjusted during operation based on the environmental characteristic. In further embodiments, the environmental characteristic is used to determine a need for support structures for tunnel 104 to prevent collapse or backfilling of tunnel 104. In addition, in some embodiments, controller 116 determines an anchoring friction force required between sections 142 of body assembly 134 and sidewall 106 to facilitate movement of body assembly 134 through interior cavity 112. As body assembly 134 moves through tunnel 104, controller 116 continuously determines environmental characteristics and dynamically updates instructions to tunneling device 102, such as movement speed of body assembly 134 through the underground location and/or direction of movement. In alternative embodiments, controller 116 utilizes the environmental characteristic in any manner that enables system 100 to operate as described herein. For example, in some embodiments, controller 116 utilizes the environmental characteristic in an operation optimizer to determine optimal operating parameters for system 100, a soil characterization algorithm, a gait or movement controller program, an inflation actuator control routine, and/or a tunnel reinforcement control program.

Referring to FIGS. 1-3, during operation, tunneling device 102 is positioned proximate surface 114 such that tip 138 engages material of the surface 114. Controller 116 sends instructions to tunneling device 102 that cause tunneling device 102 to tunnel into surface 114 and through underground locations. For example, pressurized fluid is supplied to body assembly 134 to selectively transition sections 142 of body assembly 134 between different configurations and move body assembly 134 through underground locations. Tip 138 displaces material to form interior cavity 112 as body assembly 134 moves through the unground locations. For example, tip 138 displaces the material in directions parallel and/or perpendicular to longitudinal axis 140. In the example embodiment, the cone shape of tip 138 causes material in front of tunneling device 102 to be compacted and directed at least partly in a direction perpendicular to longitudinal axis 140. Width 144 of tip 138 defines an initial width of interior cavity 112 of tunnel 104 as tip 138 displaces material. In the example embodiment, system 100 does not require an apparatus to remove at least some of the displaced material because tunneling device 102 compacts the displaced material around tunnel 104.

Moreover, sections 142 of body assembly 134 are arranged in order of increasing size from tip 138 to an opposite end of body assembly 134 such that interior cavity 112 of tunnel 104 is expanded along the extension of body assembly 134 as body assembly 134 travels through interior cavity 112. For example, first section 152, second section 154, and third section 156 of body assembly 134 are configured to contact sidewall 106 of tunnel 104 and are arranged in order of increasing size. Second width 162 of first section 152 is greater than width 144 of tip 138 such that first section 152 displaces sidewall 106 and enlarges interior cavity 112 when body assembly 134 moves through tunnel 104. In addition, fourth width 166 of second section 154 body assembly 134 is larger than second width 162 of first section 152 of body assembly 134 such that second section 154 of body assembly 134 displaces sidewall 106 of tunnel 104 and enlarges interior cavity 112 of tunnel 104 when body assembly 134 moves through tunnel 104. Tunneling device 102 iteratively displaces material and propels itself through underground locations to provide a desired length of tunnel 104.

Controller 116 sends instructions to tunneling device 102 to direct tunneling device 102 through underground locations based at least in part on the operating parameters provided by first sensor 174, second sensor 176, third sensor 178, fourth sensor 180, and/or one or more other components of system 100 and/or the environmental characteristics determined by controller 116. For example, controller 116 may generate instructions to cause tunneling device 102 to travel forward or backward in a straight direction and/or to turn as body assembly 134 propels tunneling device 102. For example, controller 116 may provide instructions that cause muscles in sections 142 of body assembly 134 to adjust and bend as sections 142 are selectively switched between configurations. In addition, controller 116 may provide instructions that determine the amount of force that force transmitter 148 delivers to tip 138. For example, controller 116 may determine the amount of force to deliver to tip 138 based on the type of material around tip 138, the characteristics of tip 138, the direction and magnitude of travel desired, and/or any other operative parameters of tunneling device 102.

During operation of tunneling device 102, in some embodiments, controller 116 receives feedback from first sensor 174, second sensor 176, third sensor 178, fourth sensor 180, and/or one or more other components of system 100 and updates a classification system for determining the environmental characteristic (e.g., controller 116 self-learns). For example, controller 116 receives feedback regarding a movement speed of body assembly 134 through the underground location and compares the movement speed to a predicted speed determined based on the environmental characteristic. Controller 116 modifies the classification system if there are differences between the measured movement speed and the predicted movement speed. Also, controller 116 receives feedback regarding a structural integrity of tunnel 104 and compares the structural integrity to a predicted structural integrity determined based on the environmental characteristic. Controller 116 modifies the classification system if there are differences between the measured structural integrity and the predicted structural integrity.

Figure 4:
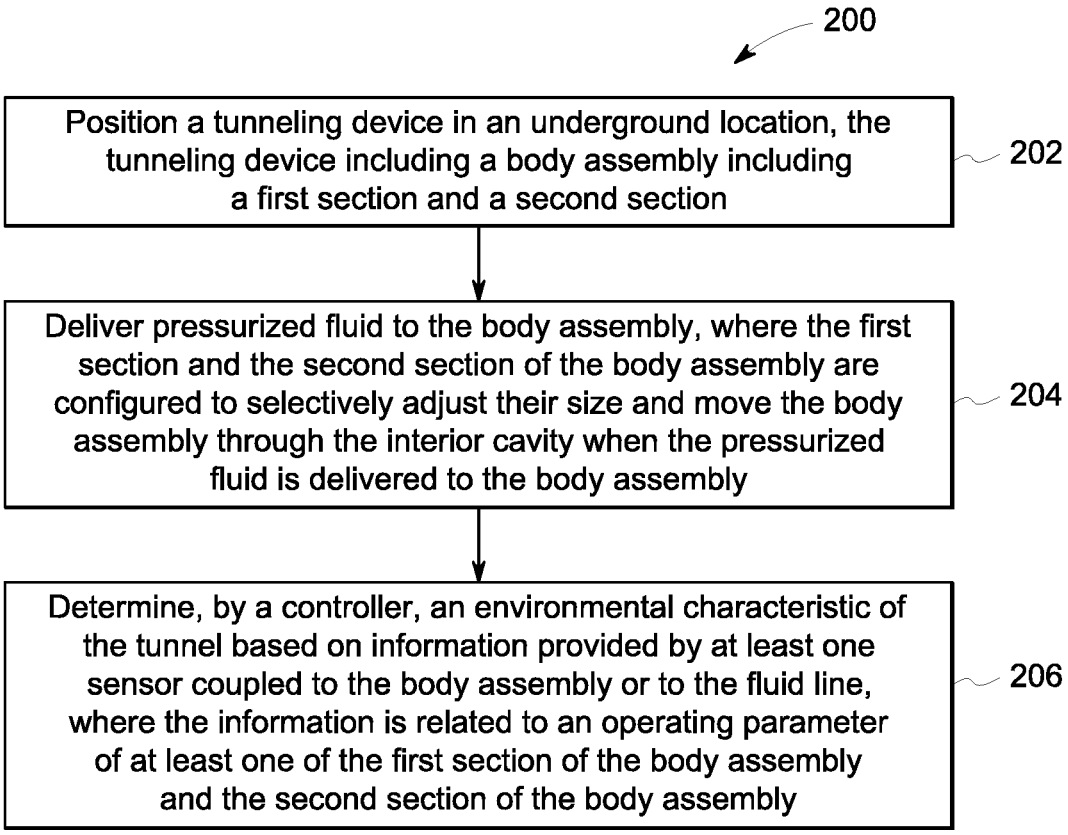
FIG. 4 is a flow chart of an example method of determining an environmental characteristic of a tunnel using the tunneling device shown in FIGS. 1-3.

FIG. 4 is a flow chart of an example method 200 of determining an environmental characteristic of tunnel 104 (shown in FIG. 1) using tunneling device 102 (shown in FIG. 1). In reference to FIGS. 1-4, method 200 includes positioning 202 tunneling device 102 in an underground location and delivering 204 pressurized fluid to body assembly 134. For example, pressurized fluid from pressurized fluid source 120 is delivered to or removed from sections 142 of body assembly 134 to sequentially adjust a length and/or a width of sections 142 and propel body assembly 134 through the underground location. In some embodiments, body assembly 134 is propelled through underground locations using the plurality of sections 142 of body assembly 134, and tip 138 is configured to displace material to form tunnel 104 as tunneling device 102 moves through the underground location.

In addition, method 200 includes determining 206, by controller 116, an environmental characteristic of tunnel 104 based on information provided by at least one sensor (e.g., first sensor 174, second sensor 176, third sensor 178, and/or fourth sensor 180) coupled to body assembly 134 or fluid line 122. In the example embodiment, the information provided by the at least one sensor is related to an operating parameter of at least one section 142 of body assembly 134. For example, in some embodiments, controller 116 determines a pressure of sections 142 of body assembly 134 based on the information provided by the at least one sensor and determines the environmental characteristic of tunnel 104 based on the determined pressure. In some embodiments, controller 116 compares operating parameters of two or more sections 142 of body assembly 134 and determines diagnostic information and/or improves the determination of the environmental characteristic based on the comparison.

In the example embodiment, any steps of method 200 are repeated any number of times required for tunneling device 102 to travel a desired distance through tunnel 104 and/or to displace material and form a desired length of tunnel 104.

Figure 5:
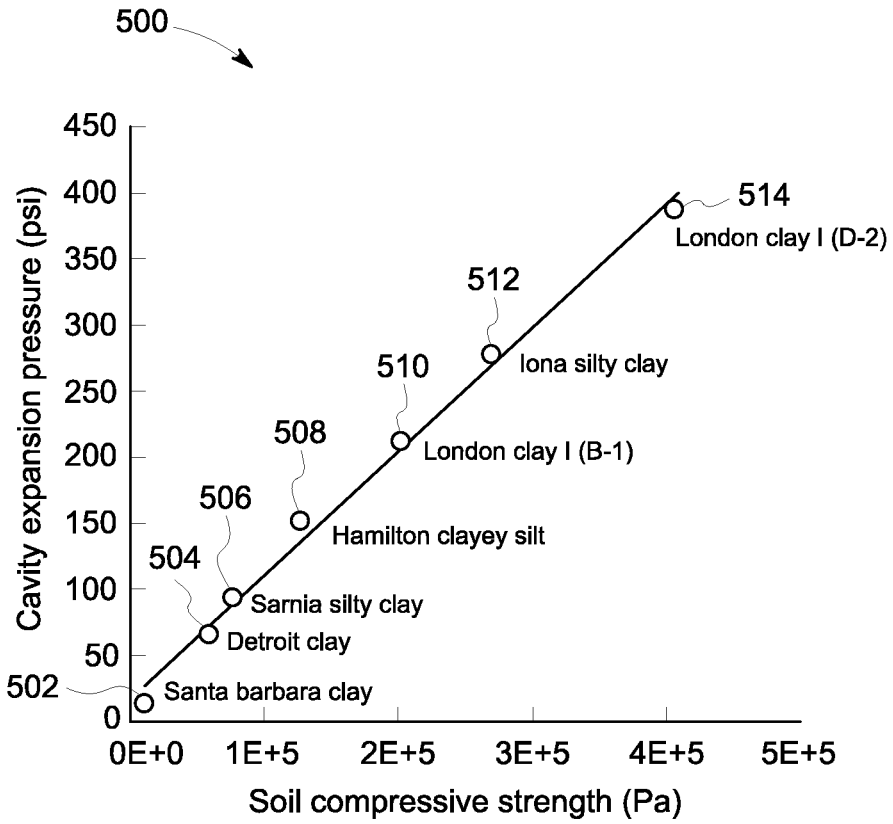
FIG. 5 is a graph illustrating cavity expansion pressure and soil compressive strength for different soil types.

FIG. 5 is a graph 500 illustrating cavity expansion pressures and soil compressive strengths for different soil types. Graph 500 includes an x-axis indicating soil compressive strength in Pascals (Pa), and a y-axis indicating cavity expansion pressure in pounds per square inch (psi). Graph 500 includes a first plot point 502 that represents a soil sample for Santa Barbara clay, a second plot point 504 that represents a soil sample for Detroit clay, a third plot point 506 that represents a soil sample for Sarnia silty clay, a fourth plot point 508 that represents a soil sample for Hamilton clayey silt, a fifth plot point 510 that represents a soil sample for London clay I (B-1), a sixth plot point 512 that represents a soil sample for Iona silty clay, and a seventh plot point 514 that represents a soil sample for London claim I (D-2).

Graph 500 illustrates a relationship between operating parameters and environmental characteristics of soil samples. In some embodiments, controller 116 (shown in FIG. 1) uses the relationship illustrated by graph 500 to determine environmental characteristics from operating parameters. For example, graph 500 may be stored in a memory of controller 116 and referred to by controller 116 to determine a soil compressive strength based on the cavity expansion pressure and a known type of soil, or to determine a type of soil based on the cavity expansion pressure and a determined soil compressive strength. In some embodiments, additional sensors are used to independently measure moisture content and/or other characteristics affecting soil compressive strength and facilitate the determination of the soil compressive strength. The type of soil and/or the soil compressive strength can be used by controller 116 to adjust operation of tunneling device 102 and facilitate tunneling device 102 traveling through underground locations. For example, the configuration or operation of tip 138 (shown in FIG. 1) may be adjusted by, for example, providing a greater force to tip 138 based on the determined soil compressive strength. In some embodiments, controller 116 includes an algorithm that provides the relationship between cavity expansion pressure and soil compressive strength and controller 116 does not directly refer to graph 500.

Figure 6:
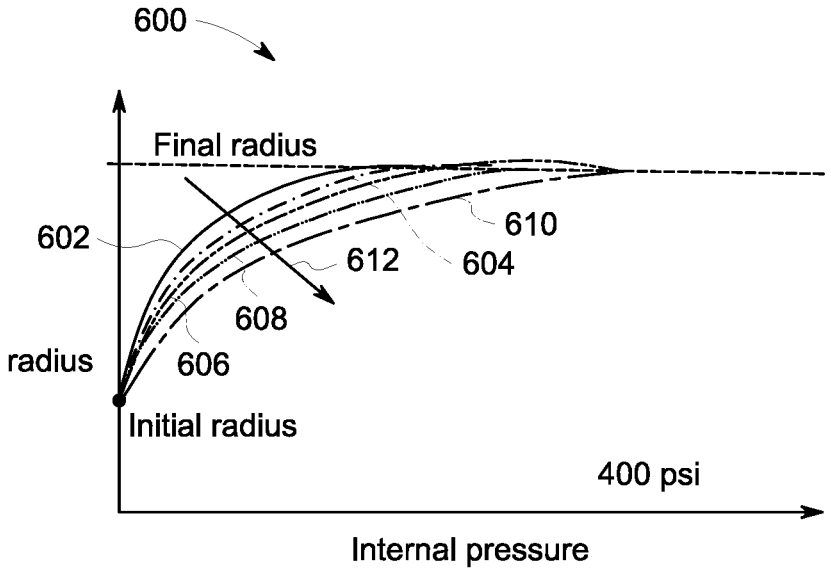
FIG. 6 is a graph illustrating radii and internal pressures of sections of a body assembly for different soil types.

FIG. 6 is a graph 600 illustrating radii and internal pressures of sections of a body assembly (e.g., sections 142 of body assembly 134 shown in FIG. 1) for different soil types. Graph 600 includes an x-axis indicating internal pressure of sections 142 in psi, and a y-axis indicating radii of sections 142. Graph 600 includes a first curve 602 representing a first type of soil, a second curve 604 representing a second type of soil, a third curve 606 representing a third type of soil, a fourth curve 608 representing a fourth type of soil, and a fifth curve 610 representing a free expansion of the section (i.e., no soil or resistance on the section). Graph 600 illustrates expansions of radii of sections of the body assembly as an internal pressure of each respective section increases. In the example embodiment, the sections each have the same radius when internal pressure is zero, but expand at different rates based on the type of soil that surrounds the sections. For example, the radii of the sections of the body assembly increase at a rate that is proportional to the soil compressive strength, which is represented by arrow 612. In particular, a section of the body assembly such as represented by curve 610 experiences a larger soil compressive strength and has smaller radius than a section of the body assembly represented by curves 602, 604, 606, 608 that is experiencing lower or no soil compressive strength at the same internal pressure.

In some embodiments, controller 116 uses graph 600 to determine environmental characteristics based on operating parameters of the body assembly. For example, in some embodiments, controller 116 identifies a soil type and/or a soil compressive strength based on information received from sensors relating to internal pressures and changes in size of sections of the body assembly. In further embodiments, controller 116 adjusts operation of the body assembly based on information in the graph 600. For example, in some embodiments, controller 116 adjusts the internal pressure of sections of the body assembly to provide a desired radius based on a known type of soil and/or soil compressive strength.

In some embodiments, controller 116 utilizes an algorithm that provides the relationship between radii, internal pressure, and soil compressive strength and controller 116 does not necessarily directly refer to graph 600. For example, equation Eq (1) can be used to determine a pressure required to expand a cavity in an elasto-plastic material:

$$P = \left(1 + \ln\left(\frac{G}{S_u}\left(\frac{1 - \left(\frac{r_{c0}}{r_C}\right)^2}{1 - \frac{S_u}{4G}}\right)\right)\right) \quad \text{Eq (1)}$$

where P is pressure of the expandable section, G is the shear modulus, $S_u$ is soil strength, $r_{c0}$ is an initial radius, and $r_c$ is an expanded radius.

A displacement or change in radius of the sections can be measured directly by displacement sensors on the sections or calculated based on the amount of fluid entering the section as measured, for example, by a flowmeter. For example, the volume of fluid inside a section of the body assembly can be calculated using equation Eq (2).

$$V = \int_0^T Q dt \quad \text{Eq (2)}$$

where V is the volume of fluid inside a section of the body assembly, T is measured time, and Q is the flow rate.

In alternative embodiments, controller 116 (shown in FIG. 1) determines environmental characteristics and/or operating parameters of the tunneling device 102 (shown in FIG. 1) in any manner that enables system 100 (shown in FIG. 1) to operate as described herein.

An example technical effect of the methods, systems, and apparatus described herein includes at least one of: (a) reducing the time to construct tunnels through underground locations; (b) enabling tunneling operations and/or inspection and repair of an interior cavity of a tunnel at greater distances from an access opening; (c) increasing the information that is available during tunneling operations; (d) providing more reliable determinations of structural integrity of tunnels during construction and identification of needs for reinforcement; (e) increasing the strength and robustness of tunnel constructions; and (f) reducing apparatus required to remove displaced material from tunnels during construction. (g) autonomous surveying of soil properties over a distributed area for purposes other than tunneling such as construction.

Example embodiments of systems and methods for use in tunneling operations are described above in detail. The methods and systems are not limited to the specific embodiments described herein, but rather, components of systems and/or steps of the methods may be utilized independently and separately from other components and/or steps described herein. For example, the method may also be used in combination with other components, and are not limited to practice only with tunnels as described herein. Rather, the example embodiment can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for use in navigating and/or forming a tunnel having a sidewall defining an interior cavity, said system comprising:

a tunneling device comprising a body assembly, wherein said body assembly comprises:

a first section; and a second section coupled to said first section;

a fluid line coupled to said body assembly, wherein said first section and said second section of said body assembly are configured to selectively adjust their size and move said body assembly through an underground location when a pressurized fluid is delivered to said body assembly through said fluid line;

a plurality of sensors configured to provide information related to an operating parameter of at least one of said first section of said body assembly and/or said second section of said body assembly, said plurality of sensors comprising a first sensor coupled to said fluid line and a second sensor coupled to said first section, said first sensor being configured to measure a flow rate of the pressurized fluid delivered to or removed from said first section through said fluid line, said second sensor configured to measure a pressure of the pressurized fluid within said first section; and a controller communicatively coupled to said at least one sensor and configured to:

determine a displacement of said first section based on the measured flow rate of the pressurized fluid; and determine an environmental characteristic of the tunnel based on both: i) the pressure of the pressurized fluid measured by said second sensor and ii) the determined displacement.

2. The system in accordance with claim 1, wherein said first section of said body assembly is configured to switch from a first configuration having a first width to a second configuration having a second width when the pressurized fluid is delivered to said first section of said body assembly, the determined displacement being proportionate to the difference between the first width and the second width, and wherein said second section of said body assembly is configured to switch from a third configuration having a third width to a fourth configuration having a fourth width when the pressurized fluid is delivered to said second section of said body assembly.

3. The system in accordance claim 2, wherein said tunneling device further comprises a tip coupled to said body assembly and configured to displace material and form a tunnel when said body assembly moves through the underground location, wherein said first section and said second section of said body assembly are configured to contact a sidewall of the tunnel, and wherein the fourth width of said second section of said body assembly is larger than the second width of said first section of said body assembly such that said second section of said body assembly is configured to engage the sidewall of the tunnel and enlarge the interior cavity of the tunnel when said body assembly moves through the underground location.

4. The system in accordance with claim 2, wherein the measured pressure includes a first pressure of said first section of said body assembly in the second configuration.

5. The system in accordance with claim 1, wherein said plurality of sensors further comprises a third sensor configured to provide information related to an additional operating parameter of said second section of said body assembly.

6. The system in accordance with claim 5, wherein said controller is configured to compare at least one of the measured flow rate and the measured pressure to the additional operating parameter of said second section of said body assembly.

7. The system in accordance with claim 1, wherein said controller is communicatively coupled to said body assembly and is configured to provide instructions to move said body assembly through the underground location.

8. The system in accordance with claim 1, wherein the plurality of sensors are further configured to collectively measure at least one of the following:

a second pressure of said second section of said body assembly and a flow rate of the pressurized fluid delivered to or removed from said second section through said fluid line; and/or the second pressure of said second section of said body assembly and a change in size of said second section of said body assembly when the pressurized fluid is delivered to or removed from said second section of said body assembly through said fluid line.

9. The system in accordance with claim 1, wherein said controller is on board said tunneling device.

10. A tunneling device comprising:

a body assembly comprising:

a first section configured to switch from a first configuration having a first width to a second configuration having a second width when a pressurized fluid is delivered to said first section; and a second section coupled to said first section and configured to switch from a third configuration having a third width to a fourth configuration having a fourth width when the pressurized fluid is delivered to said second section, wherein said first section and said second section of said body assembly are configured to selectively switch between the first configuration and the second configuration and between the third configuration and the fourth configuration and move said body assembly through an underground location; and a plurality of sensors comprising a first sensor and a second sensor coupled to said first section, said first sensor being configured to measure a flow rate of the pressurized fluid delivered to or removed from said first section, said second sensor configured to measure a pressure of the pressurized fluid within said first section, wherein a controller is configured to determine a displacement of said first section based on the measured flow rate of the pressurized fluid, said controller being further configured to determine an environmental characteristic based on both: i) the pressure of the pressurized fluid measured by said second sensor and ii) the determined displacement, said controller being further configured to provide instructions to move said body assembly through the underground location; and a tip coupled to said body assembly and configured to displace material and form a tunnel having a sidewall defining an interior cavity when said body assembly moves through the underground location, wherein the fourth width of said second section of said body assembly is larger than the second width of said first section of said body assembly such that said second section of said body assembly is configured to engage the sidewall of the tunnel and enlarge the interior cavity of the tunnel when said body assembly moves through the underground location.

11. The tunneling device in accordance with claim 10, further comprising a fluid line coupled to said body assembly, wherein said first section and said second section of said body assembly are configured to selectively adjust their size and move said body assembly through the underground location when the pressurized fluid is delivered to or removed from said first section of said body assembly and said second section of said body assembly through said fluid line.

12. The tunneling device in accordance with claim 11, wherein said second sensor is coupled to said body assembly and said first sensor is coupled to said fluid line.

13. The tunneling device in accordance with claim 12, wherein said plurality of sensors further comprises a third sensor configured to provide information related to an additional operating parameter of said second section of said body assembly.

14. The tunneling device in accordance with claim 10, wherein said first section of said body assembly has a first radius in the first configuration and a second radius in the second configuration, and wherein said second section of said body assembly has a third radius in the third configuration and a fourth radius in the fourth configuration.

15. The tunneling device in accordance with claim 10, wherein said body assembly further comprises a third section coupled to said second section and configured to switch from a fifth configuration having a fifth width to a sixth configuration having a sixth width when the pressurized fluid is delivered to said third section.

16. A method for determining an environmental characteristic of a tunnel, said method comprising:

positioning a tunneling device in an underground location, the tunneling device including a body assembly including a first section and a second section;

delivering, via a fluid line, pressurized fluid to the body assembly, wherein the first section and the second section of the body assembly are configured to selectively adjust their size and move the body assembly through the underground location when the pressurized fluid is delivered to the body assembly;

measuring, by a first sensor of a plurality of sensors, a flow rate of the pressurized fluid delivered to or removed from the first section through the fluid line, the first sensor being coupled to the fluid line;

measuring, by a second sensor of the plurality of sensors, a pressure of the pressurized fluid within the first section of the body assembly, the second sensor being coupled to the first section of the body assembly; and determining, by a controller, a displacement of the first section based on the measured flow rate of the pressurized fluid; and determining, by the controller, the environmental characteristic of the tunnel based on both: i) the determined displacement and ii) the pressure of the pressurized fluid measured by the second sensor.

17. The method in accordance with claim 16, wherein delivering pressurized fluid to the body assembly comprises:

delivering pressurized fluid to the first section to switch the first section from a first configuration having a first width to a second configuration having a second width; and delivering pressurized fluid to the second section to switch the second section from a third configuration having a third width to a fourth configuration having a fourth width.

18. The method in accordance with claim 17, wherein the measured pressure includes a first pressure of the first section of the body assembly in the second configuration.

19. The method in accordance with claim 17, further comprising displacing material using a tip coupled to the body assembly to form the tunnel as the tunneling device moves through an underground location, wherein the fourth width of the second section of the body assembly is larger than the second width of the first section of the body assembly such that the second section of the body assembly is configured to engage a sidewall of the tunnel and enlarge an interior cavity of the tunnel when the body assembly moves through the underground location.

20. The method in accordance with claim 16, wherein the plurality of sensors further comprises a third sensor configured to provide information related to an additional operating parameter of the second section of the body assembly, the method further comprising comparing at least one of the measured flow rate and the measured pressure to the additional operating parameter of the second section of the body assembly.

* * * * *